US006378450B1

(12) United States Patent
Begnaud et al.

(10) Patent No.: US 6,378,450 B1
(45) Date of Patent: Apr. 30, 2002

(54) DYNAMICALLY POSITIONED SEMI-SUBMERSIBLE DRILLING VESSEL WITH SLENDER HORIZONTAL BRACES

(75) Inventors: Eugene E. Begnaud, New Orleans; Calvin V. Norton, Gretna; Bruce Malcolm, New Orleans, all of LA (US)

(73) Assignee: Friede & Goldman, Ltd., Houston, TX (US)

( * ) Notice: Subject to any disclaimer, the term of this patent is extended or adjusted under 35 U.S.C. 154(b) by 0 days.

(21) Appl. No.: 09/496,978

(22) Filed: Feb. 2, 2000

Related U.S. Application Data

(63) Continuation-in-part of application No. 09/071,528, filed on May 1, 1998, now abandoned.

(51) Int. Cl.[7] ..... B63B 35/44

(52) U.S. Cl. ..... 114/264; 114/265; 405/195.1; 405/200

(58) Field of Search ..... 405/195.1, 196, 405/197, 200, 223.1, 224, 224.2; 114/256, 264, 265, 266

(56) References Cited

U.S. PATENT DOCUMENTS 3,279,407 A * 10/1966 Stenger ..... 114/264
3,886,886 A * 6/1975 Anders ..... 114/125
4,232,625 A * 11/1980 Goren et al. ..... 114/264
4,281,615 A * 8/1981 Wilson et al. ..... 114/265
4,436,050 A * 3/1984 Liden ..... 114/265
4,498,412 A * 2/1985 Liden ..... 114/256
4,899,682 A * 2/1990 Pouget et al. ..... 114/265

* cited by examiner

*Primary Examiner*—David Bagnell
*Assistant Examiner*—Frederick L. Lagman
(74) *Attorney, Agent, or Firm*—Keaty Professional Law Corporation

(57) ABSTRACT

The invention relates to a semi-submersible vessel designed to operate in harsh environment. The vessel has a twin-hull pontoon structure that supports four corner caissons extending vertically from the pontoons above an operational draft of the vessel. A pair of slender parallel horizontal braces connects each pair of opposing caissons, the braces extending in a general plane perpendicular to longitudinal axes of the pontoons. One of the pair of braces is secured between the forward columns and another of the pair of braces is secured between the aft columns. The braces reduce spreading and torque-induced forces acting on the columns, while not substantially increasing water plane area of the vessel. Each brace has an internal "redundancy" feature, being divided into two independent watertight compartments to continue providing buoyancy to the structure if one of the compartments is breached. Station keeping is accomplished with a full dynamically positioned system consisting of a plurality of thruster assemblies mounted on the starboard and port sides of the pontoon hull.

14 Claims, 7 Drawing Sheets

DYNAMICALLY POSITIONED SEMI-SUBMERSIBLE DRILLING VESSEL WITH SLENDER HORIZONTAL BRACES

CROSS-REFERENCE TO RELATED APPLICATIONS

This application is a continuation-in-part of our co-pending application Ser. No. 09/071,528 now abandoned filed on May 1, 1998 entitled "Dynamically Positioned Semi-Submersible Drilling Vessel," the full disclosure of which is incorporated by reference herein.

BACKGROUND OF THE INVENTION

The invention relates to an offshore drilling unit, and more particularly to a semi-submersible vessel for conducting offshore operations in moderate or severe environments, such as the Gulf of Mexico, the North Sea, offshore Newfoundland, and the like.

In recent years, the drilling operations have been conducted at increasingly greater distance from the shoreline, placing the offshore production or drilling facilities in often severe weather conditions. In such environments it is particularly important to have a stable floating facility for supporting the mineral exploration and production operations, as well as providing living accommodations to the crew and storage for the necessary equipment. In deep waters, over 7500 feet, it becomes particularly advantageous to deploy floating semi-submersible vessels, as opposed to fixed bottom anchored structures.

Designs of semi-submersible vessels utilize buoyant pontoons, or lower hulls which support a plurality of vertically extending columns, the upper portions of which carry a working platform. Some of the semi-submersible vessels can have a single caisson, or column, usually denoted as a buoy while others utilize three or more columns extended upwardly from buoyant pontoons.

In many such structures, vertical or diagonal braces are used between the columns, the braces contributing to the water plane area of the vessel. The braces are usually constructed with smaller diameters than that of the columns and are therefore more vulnerable to the environmental and mechanical damage. If the connecting braces are damaged, the entire structure becomes jeopardized.

One example of a single-brace structure is shown in U.S. Pat. No. 4,436,050 issued on Mar. 13, 1984 to Hadar Liden entitled "Semi-Submersible Vessel." The '050 patent discloses a two-pontoon, four-column structure, with a pair of columns being mounted on a respective underwater hull, or pontoon. One transverse horizontal stay is mounted between each pair of the columns at the ends of the underwater hulls. The object of the '050 patent design is to simplify the construction and to reduce the resistance to water flow. However, the minimal number of braces may be less beneficial where spreading forces acting on the four columns are relatively high and torque imposed on the columns by the pontoon lateral bending tends to twist a column structure in the direction of the prevailing wind and wave forces.

There also exist numerous designs of semi-submersible vessels using diagonal braces in addition to horizontal stays. These tend reinforce the support structure of the platforms and resist destructive forces of the ocean waves. Some of the designs using diagonal braces are shown in U.S. Pat. No. 4,232,625 (Goren) and U.S. Pat. No. 4,281,615 (Wilson et al.). One of the disadvantages of the diagonal braces is increase in water plane area of the vessel, which adversely affects the weight, wave resistance and overall cost of the vessel.

Another consideration that is taken into account when designing semi-submersible vessels is resistance of the vessels to heave and roll motion induced by waves. The vessels must have sufficient stability to withstand wave motions to allow the mineral exploration and production operations to be carried out in safety.

This consideration becomes particularly important in harsh environments where strong winds and waves are prevalent throughout the year. The present invention contemplates provision of a semi-submersible vessel, particularly adapted for use in hostile environment, a vessel with improved safety features and high maneuverability.

SUMMARY OF THE INVENTION

It is, therefore, an object of the present invention to provide a semi-submersible vessel with improved safety features.

It is another object of the invention to provide a semi-submersible vessel with a limited number of horizontal braces assuring minimal increase in water plane area, while resisting spreading and twisting forces acting on the supporting columns.

These and other objects of the invention are achieved through a provision of a semi-submersible vessel for use in particularly harsh environment. The vessel comprises a pair of parallel buoyant pontoons having a generally rectangular configuration and divided into a plurality of independent compartments. Four columns, or caissons are mounted on the pontoons and extend vertically to support the upper deck of an offshore platform suitable for conducting mineral exploration or production operations.

Two pairs of parallel braces are secured transversely between the pontoons, one pair of parallel horizontal braces between aft columns and one pair of parallel horizontal braces between the forward columns, the braces extending generally perpendicularly to longitudinal axes of the elongated pontoons. The vessel has a relatively small water plane area since it does not require diagonal braces to reinforce the support column structure, and the horizontal braces are relatively small in diameter.

The horizontal braces offer fixity to column twisting due to the lower hull pontoon lateral bending between the fore and aft columns caused by wave and current forces. Lateral secondary bending due to quartering seas is reduced due to the utilization of more compact bracing members having lower lateral bending inertia properties. The vessel uses no diagonal braces, thereby keeping the water plane area at a minimum.

In addition to added resistance to spreading and twisting forces acting on the columns the horizontal braces offer a certain redundancy—if one of the braces becomes damaged the second brace takes up the entire load of securing the pair of columns until such time as the damaged brace can be repaired.

Each horizontal brace is provided with internal "redundancy" features—they contain two independent watertight compartments. A bulkhead divides an oblong brace into two independent sections to retain stability of the vessel even if the structural integrity of a compartment wall is compromised by wave motions or physical objects striking the brace. In that manner, even if one section of the wall is damaged, the second independent buoyant compartment will help to retain structural capability at severe environmental occurrences.

The vessel is moored at a location using dynamically positioned thruster assemblies mounted on the pontoons.

The thruster unit extends below the pontoon, while a motor which independently drives a respective thruster unit, is mounted inside a thruster room within the pontoon. A passageway between the thruster rooms in the pontoons allows access to the thruster assemblies, with the passageway communicating with the platform at a level above an operating draft of the vessel.

To minimize drag forces induced by wave motions, the columns and hulls of the pontoons are provided with outwardly convex, rounded corners. This design reduces drag force transmitted when mooring or moving the vessel. The pontoon hulls have compartments for storing ballast, drill water and other necessary supplies.

The columns, or caissons house reserve mud tanks, ballast tanks, force air ventilation supply and other necessary machinery and equipment. An integrated box deck structure houses drilling and ship service equipment, power generation, storage for liquid mud and other miscellaneous objects. Living quarters and service equipment are mounted on the platform, as well.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Turning now to the drawings in more detail, numeral 10 designates the semi-submersible vessel of the present invention. The vessel comprises a pair of floating buoyant hulls, or pontoons 12, 14 divided into a plurality of watertight compartments for accommodating ballast, as well as allowing access to thruster assemblies, as will be described in more detail hereinafter. Secured to the upper portions 16 and 18 of the pontoons 12 and 14, respectively, are columns, or caissons 20,22,24 and 26 that extend in a transverse relationship to the vertical axes of the pontoons 12 and 14.

Figure 2:
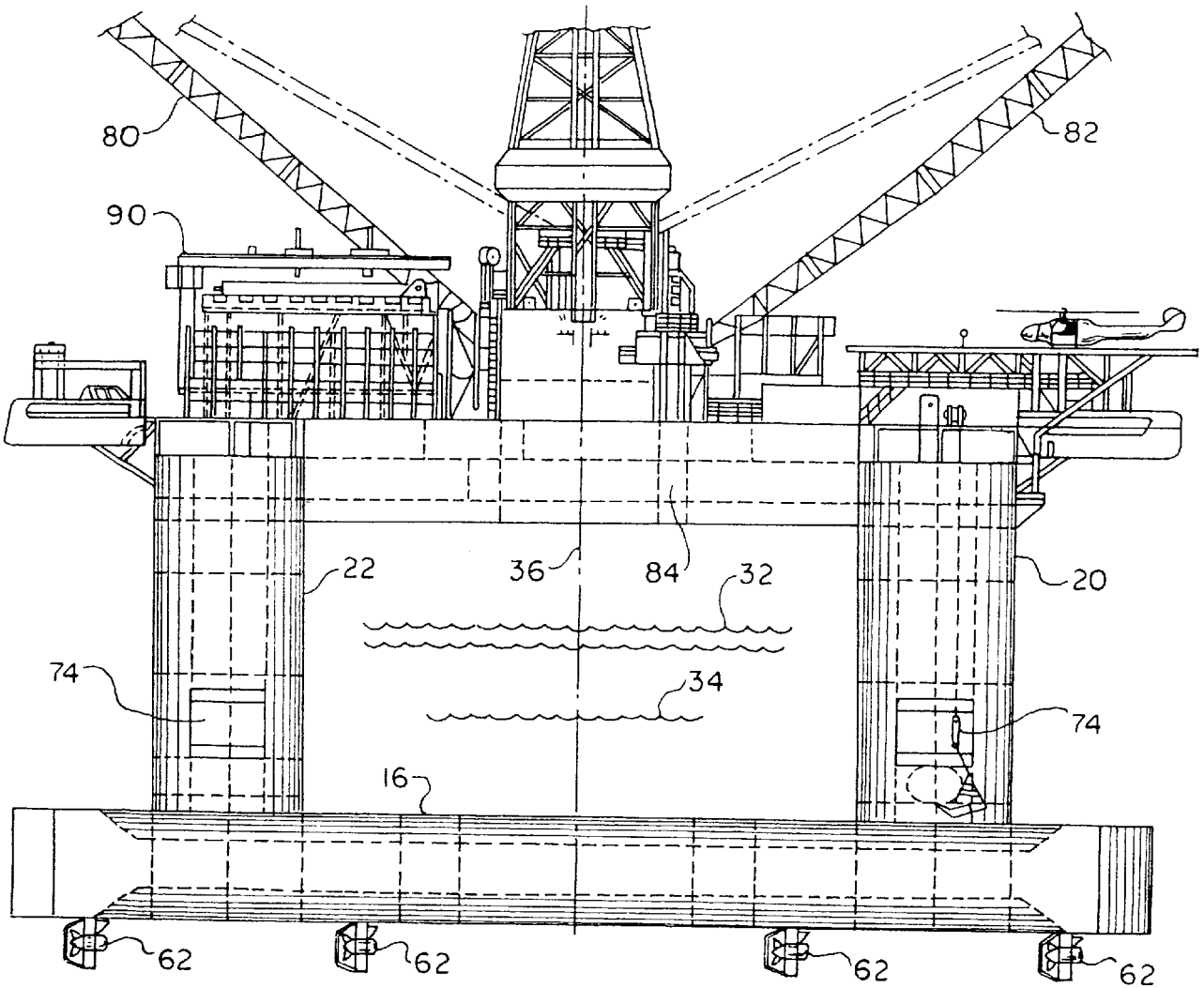
FIG. 2 is an outboard profile illustration of the vessel in accordance with the present invention.

The upper portions of the columns 20,22,24, and 26 carry a platform 30 adapted for supporting mineral exploration and production operations. As shown in FIG. 2, parts of the columns 20–26, as well as pontoons 12 and 14 are submerged below the water surface to an operational draft 32, while the upper portions of the columns 20–26 and platform 30 are elevated to a level above maximum expected wave for a particular location. The ballast chambers in the pontoons 12 and 14 provide the necessary room for introducing a ballast, for example, sea water to partially submerge the structure.

The operational draft 32 is generally higher than a survival draft 34 (FIG. 2) by 15 to 25 feet. When the vessel 10 encounters particularly harsh conditions, wave and hydrostatic forces act on the pontoons and on the columns, causing the vessel 10 to move vertically and angularly, subjecting the vessel to heave and pitch motions of the wave.

Heave and pitch or roll motion is due to the wave actions on the pontoons and columns. These forces which cause vertical and angular motions of the vessel result in the vessel shifting in relation to a vertical to axis 36 of the vessel 10. The angular motion of the vessel 10 is reacted by inertia and hydrostatic forces.

Figure 1:
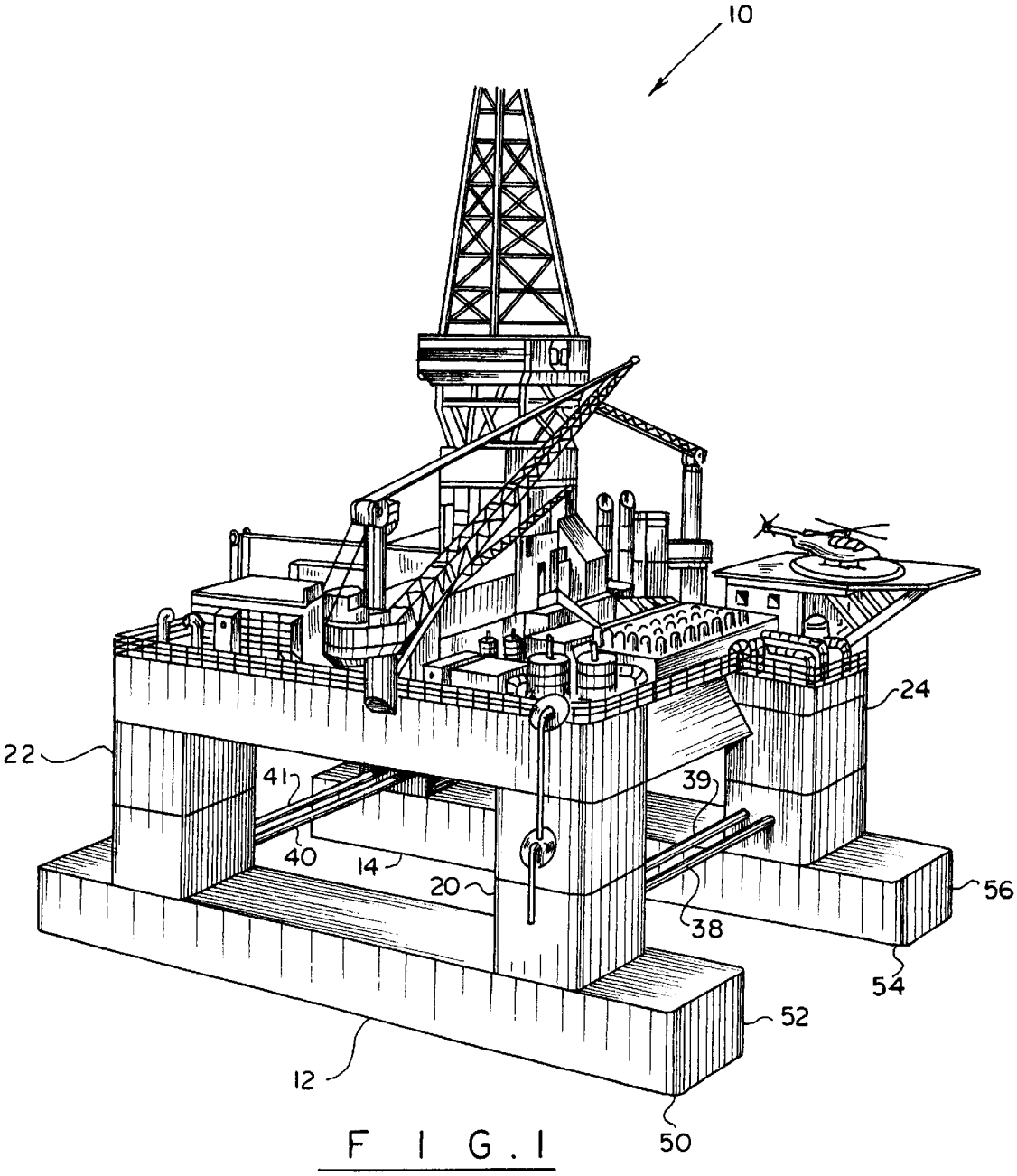
FIG. 1 is a perspective view of the semi-submersible vessel in accordance with the present invention.
Figure 4:
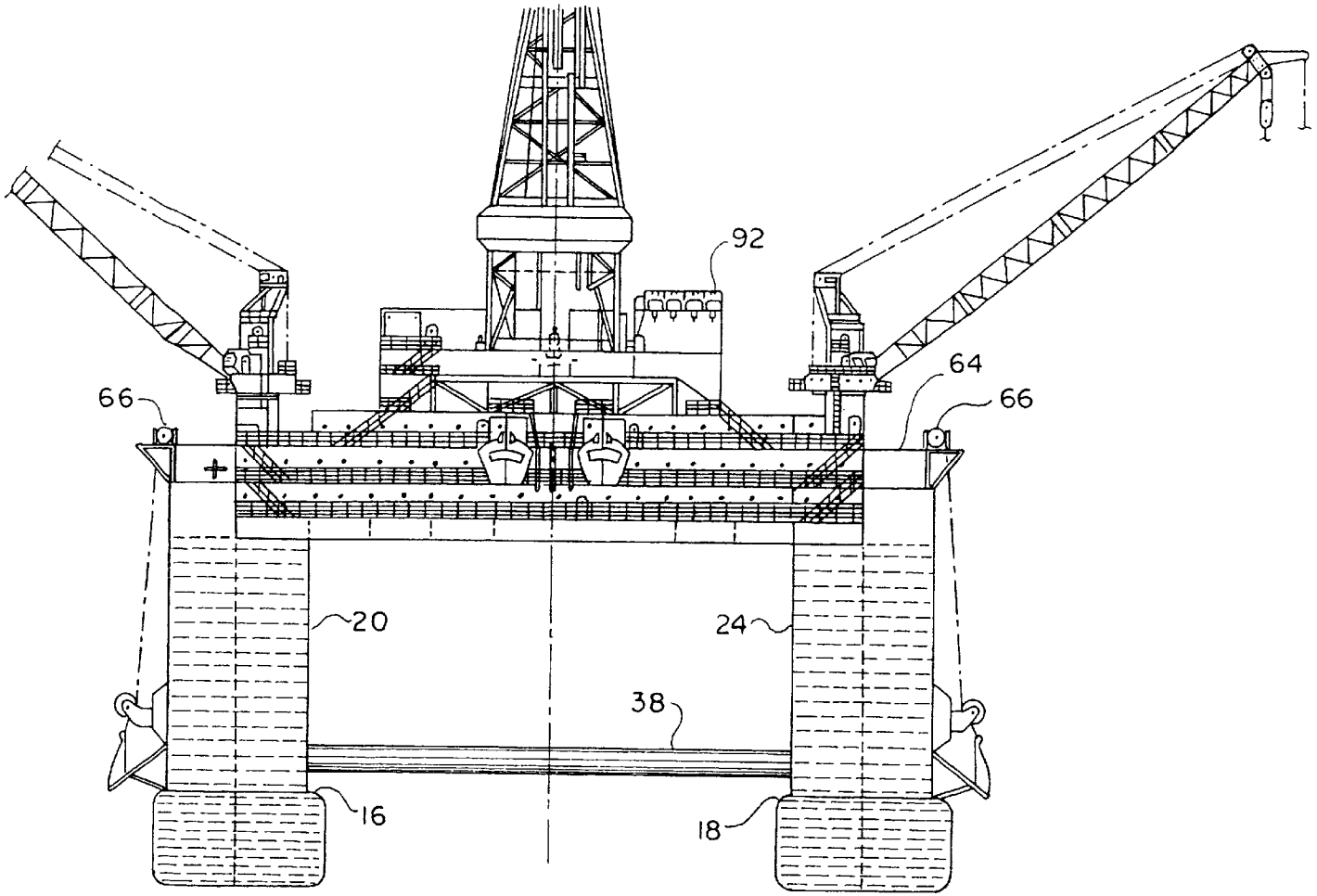
FIG. 4 is an elevational view of bow of the semi-submersible vessel of the present invention.
Figure 5:
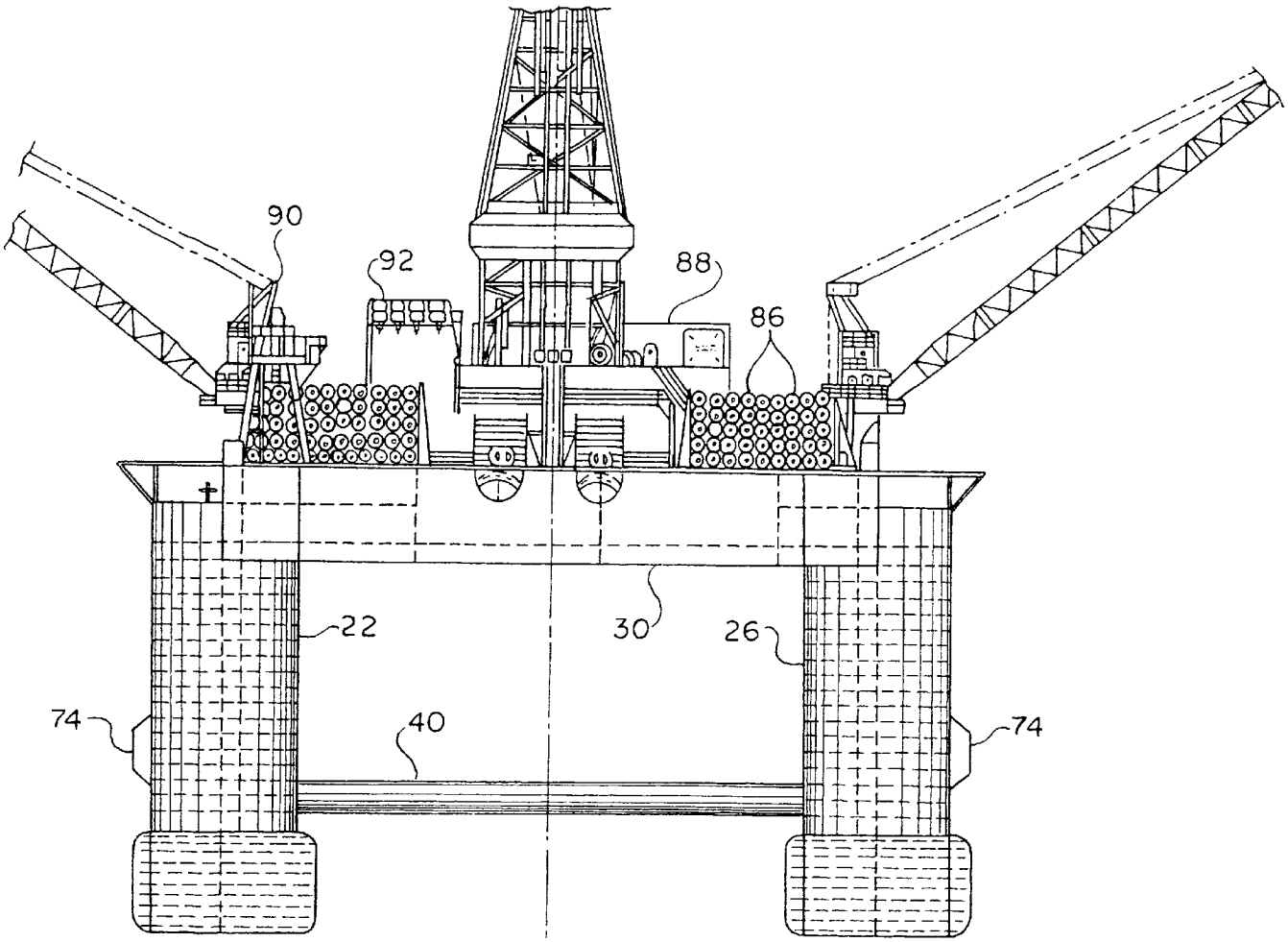
FIG. 5 is an elevational view of stem of the vessel of the present invention.

Substantially parallel horizontal braces 38,39 and 40,41 extend between columns 20, 24, and 22,26, respectively, as can be seen in FIGS. 1, 4 and 5. The horizontal braces 38, 39,40 and 41 connect the opposing pairs of columns at a vertical level above the pontoons 12 and 14 and below the survival draft 34 of the vessel 10. Horizontal braces 38, 39 are positioned between the forward columns 20,24, and braces 40,41 are positioned between the aft columns 22, 26. The braces 38–41 are secured to the columns 20, 22, 24, and 26 in the area adjacent to the columns' mid-section in a horizontal plane.

As can be seen in FIG. 1, the parallel braces 38, 39 are positioned relatively close to each other on opposite side of an imaginary centerline passing vertically through the columns 20, 24. Similarly, the parallel braces 40, 41 are positioned relatively close to each other on opposite side of an imaginary centerline passing vertically through the columns 22, 26.

The slender braces 38–41 do not substantially increase the water plane area of the vessel, while offering increased stability and resistance to spreading and torque-induced forces acting on the columns in particularly harsh environments. Due to wave and current forces the pontoons 12 and 14 bend laterally between fore and aft columns. The braces 38–41 create a certain fixity, or rigidity, resisting the columns twisting.

Additionally, the double-brace design allows to reduce lateral secondary bending of pontoons due to quartering seas. This effect is achieved through the use of more compact bracing members having lower lateral bending inertia properties. The vessel 10 uses no diagonal braces, instead relying on the pairs of horizontal braces for keeping the columns in a stable, rigid position.

Figure 3:
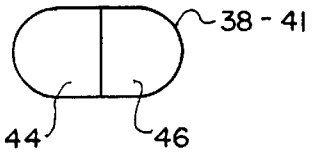
FIG. 3 is a cross-sectional view of a horizontal brace for use in the vessel of the present invention.

Each brace 38–41 is provided with an internal "redundancy" feature. As shown in FIG. 3, each horizontal brace 38,39,40 or 41 has a generally oval, or oblong cross section and is provided with an internal bulk head 42 which divides the brace into two equal longitudinal sections. The bulkhead 42 defines two independent compartments 44 and 46 in each of the slender braces 38–41. The compartments are watertight and if the wall of one of the compartments is damaged or penetrated, the second compartment will survive, continuing to connect the columns and contribute to the stability of the vessel 10 on the water.

Each pair of braces 38, 39 and 40, 41 is designed to further increase stability of the vessel by offering "external" redundancy feature. If any of the braces 38–41 becomes damaged, such as by an approaching tug boat, or debris floating in the water, the second of the pair of braces takes up the loads and continues to rigidly connect the respective columns until such time as the damaged brace is repaired.

Figure 8:
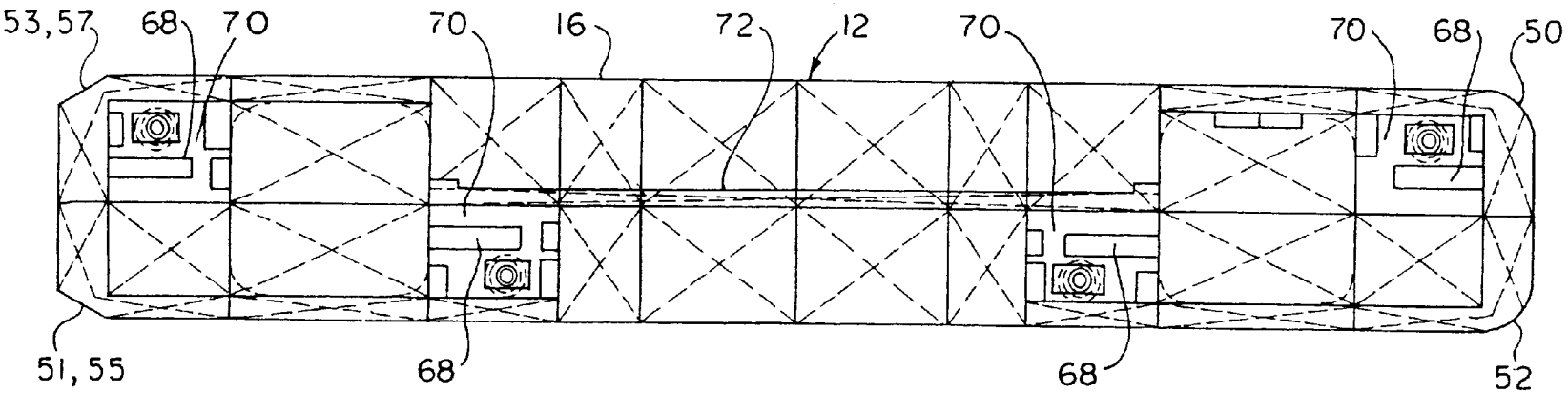
FIG. 8 is a schematic view of a pontoon interior showing ballast compartments.

To improve the drag characteristics of the vessel, that is to minimize drag, the bow corners of the pontoons are formed with rounded vertical side walls 50,52,54 and 56 (FIG. 1, bow portion). Angular vertical side walls 51, 53, 55, and 57 are provided in the aft sections of the pontoons 12 and 14, as can be seen in FIGS. 1 and 8.

Figure 7:
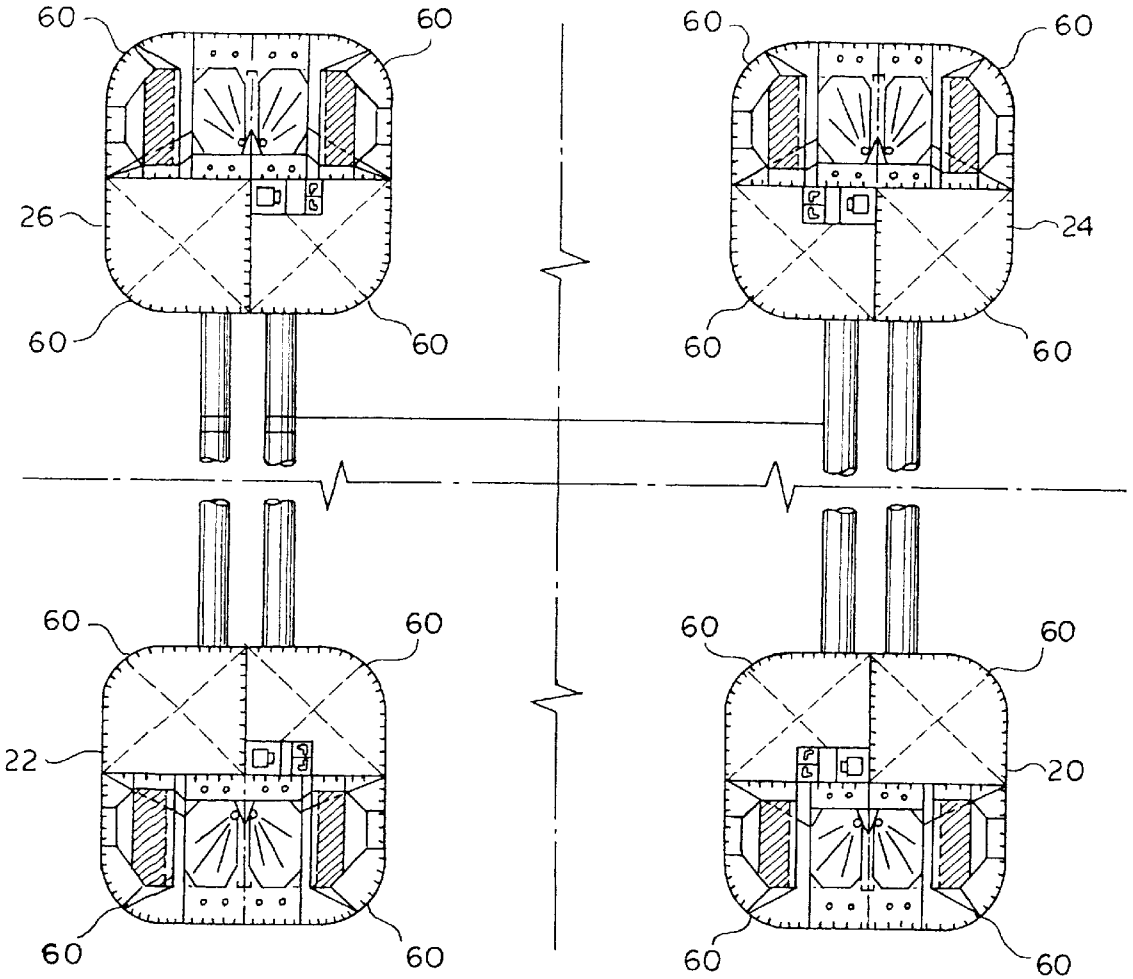
FIG. 7 is an elevational view of columns forming part of the vessel of the present invention.

As can be better seen in FIG. 7, each column, or caisson 20, 22, 24, and 26 has rounded corners 60 of a discrete radius. This radius can be, for example ¼ or greater of the depth or width of the generally square caisson. Such rounded corners allow to minimize drag forces, while still providing the necessary strength to the corner columns. Additionally, the constructability of the caissons is greatly improved, as flat panels can be mostly used, reducing the overall cost of the vessel construction.

The vessel 10 is provided with a full dynamically positioned system of station keeping. The system consists of eight 360° fixed pitch variable speed azimuthing thruster assemblies secured to the bottom of the pontoon 12, and in a preferred embodiment, a pair of thruster assemblies is located at starboard and a pair at port side of each pontoon 12 and 14. It is believed that this system is sufficient for water depths up to 10,000 feet.

Mounted on the main deck 64 of the platform 30 are a pair of winches 66, one at each forward column 20 and 24 (FIG. 4). The winches 66 are designed to hold a length of wire rope for harbor mooring. If desired, the number of winches can be increased up to eight, for an 8-point pre-set mooring configuration.

Figure 6:
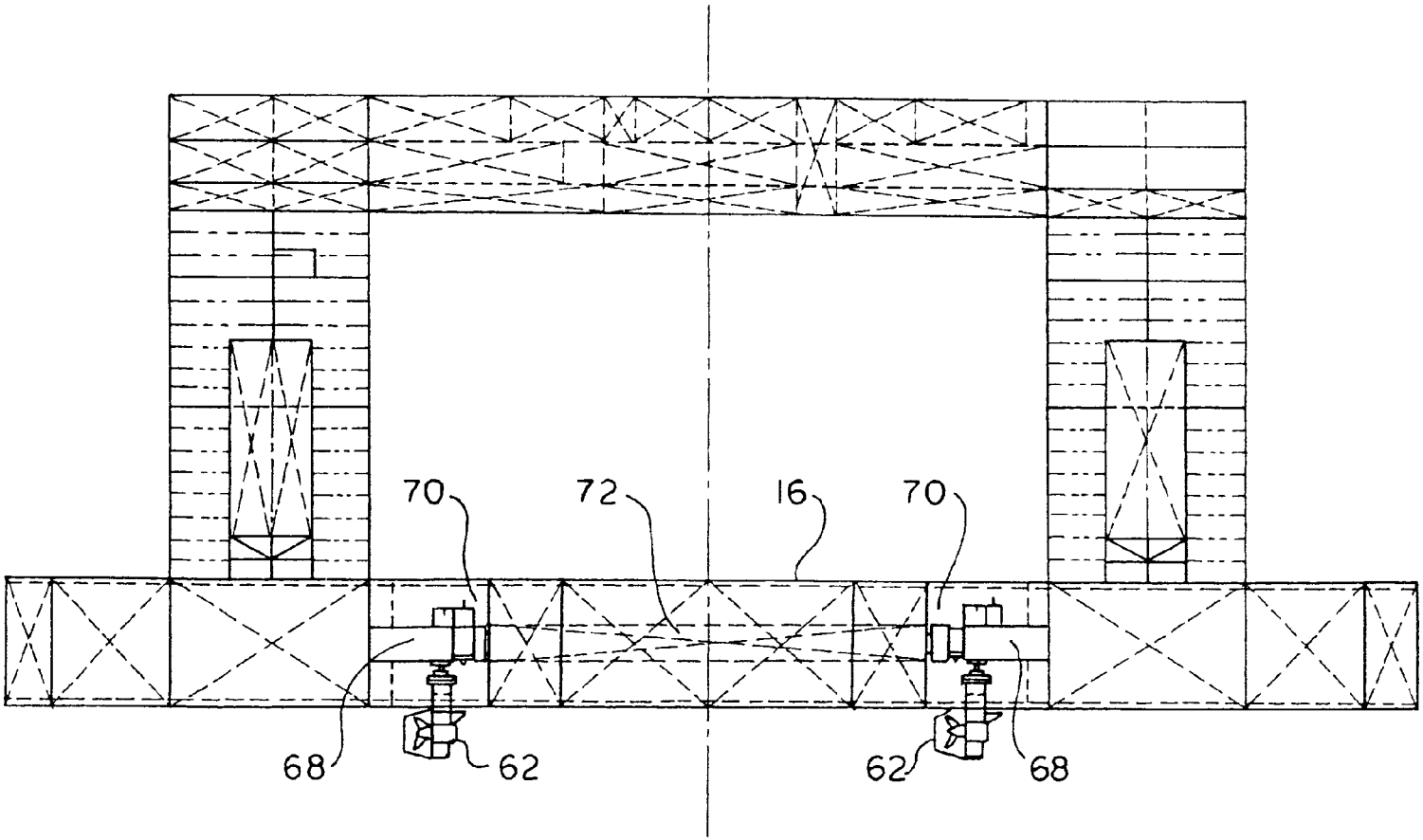
FIG. 6 is a longitudinal sectional view of starboard outboard portion of the vessel.

Turning now to FIG. 6 of the drawings, the thruster units 62 are seen connected to a drive motor means 68 positioned in a specially provided thruster room 70. The motor means 68 can be AC drive, or other similar means. To facilitate maintenance, installation and removal of thrusters 62, a passageway 72 is formed in the hull body 12 and 14.

The passageway 72 extends between thruster rooms 70, the passageway 72 communicating with platform 30 at a level above the operational draft 32. The thruster rooms 68 can be accessed directly from the upper deck 64, or cranes can be used to get access to the thruster rooms 70. The vessel 10 uses ballasted pontoons and caissons for operational stability. The substructure loads are distributed through columns 20–26.

The caissons 20–26 carry a box-shaped buoyant attachments 74 secured at a general area of survival draft 34. By carefully selecting the position of the members 74, it is possible to maximize the survival conditions of the vessel. An additional benefit of the buoyant members 74 is that there is no reduction in load capability on the vessel between operating draft and survival draft.

The members 74 give variable load capability and water plane displacement. The members 74 do not substantially affect water plane area at operational draft as their position is below the draft level 32. It is important that the members 74 do not extend past the flat portion of the caissons 20–26, but rather extend in vertical alignment with the outer wall of the lower hull pontoon.

Since the outer limits of the attachments 74 do not pass the vertical line of the pontoon outer wall, ease of construction of the vessel 10 at dry dock is facilitated. The outer limits of the width of the outer walls of the members 74 terminate before the outwardly convex corners 60 of the columns 20–26 begin to curve.

The vessel 10 provides a facility for conducting mineral exploration in relatively deep waters of up to 10,000 feet. The vessel 10 is equipped with a pair of cranes 80, 82 mounted on crane pedestals 84. Drilling and production operations are conducted through the platform 30 in a manner well known to those skilled in the art. Riser sections 86 (FIG. 5) are stored on the main deck, and can be delivered to the drill floor 88 in an efficient, cost effective manner.

The compartments formed in the pontoon 12 and 14, in addition to holding salt water ballast, are equipped for housing pumps, storing drill water, diesel oil and other necessary materials. The caissons 20–24 are also compartmentalized to hold reserve mud tanks, brine tanks, base oil tanks, ballast tanks, vents, ventilation supplies and return pipes for lower hull and column machinery compartments.

Other equipment necessary for offshore operations, such as, sewerage treatment unit, portable water tanks, storage tanks can be positioned in other compartments within the columns 20–26. The upper hull, or platform 30 structure uses an integrated box deck structure to house drilling and ship service equipment, power generation and storage for liquid mud, sacks, and other variable materials and equipment.

Two gantry cranes are provided. One of the gantry cranes 90 can be used to run a riser, while another gantry crane 92 can be provided over the blowout preventor for splitting the storage area stack. This storage area can also be used to run sub-sea trees. The living quarters on the platform 10 can accommodate the necessary number of crew members for conducting the mineral exploration and production operations.

The rounded corners of the pontoons and columns require less effort to maintain position of the vessel at a selected location above the drilling area. As a result, less power is required, less fuel is used, and the mineral exploration and production operations run more efficiently. The vessel 10 uses no anchors for remaining in place but rather a dynamically positioned system utilizing azimuthing thrusters for increased efficiency of the vessel.

Many changes and modifications can be made in the design of the present invention without departing from the spirit thereof. We, therefore, pray that our rights to the present invention be limited only by the scope of the appended claims.

We claim:

1. A semi-submersible vessel, comprising:

a pair of buoyant pontoons;

a plurality of vertically extending columns supported by said pontoons, upper portions of said pontoons carrying a platform adapted for conducting offshore operations therefrom; a pair of parallel horizontal braces extending between each pair of opposing columns, one of said pair of horizontal braces being positioned between opposing forward columns and another of said pair of horizontal braces being positioned between opposing aft columns, said braces resisting spreading and torque-inducing forces acting on said columns due to pontoons' lateral bending, each of said braces having a generally oval cross-section to minimize drag forces on each of said braces induced by wave motions.

2. The vessel of claim 1, further comprising a dynamically positioned station keeping means connected to said pontoons for retaining said vessel in a desired offshore location.

3. The vessel of claim 2, wherein said station keeping means comprises a plurality of independently controlled thruster assemblies.

4. The vessel of claim 3, wherein each of said thruster assemblies comprises a thruster unit mounted below a pontoon and a driving motor positioned inside a pontoon and operationally connected to said thruster unit.

5. The vessel of claim 2, wherein said station keeping means comprises a plurality of independently operating thruster assemblies, said thruster assemblies being mounted in pairs adjacent a starboard and port side of each of said pontoons.

6. A semi-submersible vessel, comprising:

a pair of buoyant pontoons;

a plurality of vertically extending columns supported by said pontoons, upper portions of said pontoons carrying a platform adapted for conducting offshore operations therefrom;

a pair of parallel horizontal braces extending between each pair of opposing columns, one of said pair of horizontal braces being positioned between opposing forward columns and another of said pair of horizontal braces being positioned between opposing aft columns, said braces resisting spreading and torque-inducing forces acting on said columns due to pontoons' lateral bending;

a dynamically positioned station keeping means connected to said pontoon for retaining said vessel in a desired offshore location, said station keeping means comprising a plurality of independently controlled thruster assemblies; and wherein a passageway is formed in each of said pontoons, said passageway allowing access to said thruster assemblies, said passageway communicating with said platform at a level above an operational draft of the vessel.

7. A semi-submersible vessel, comprising:

a pair of buoyant pontoons;

a plurality of vertically extending buoyant caissons supported by said pontoons and arranged in pairs on each of said pontoons, upper portions of said caissons supporting a platform for conducting offshore operations;

a plurality of parallel horizontal braces extending between each pair of opposing caissons in a transverse relationship to longitudinal axes of said pontoons, one of said pair of said horizontal braces being positioned between opposing forward caissons and another of pair of said horizontal braces being positioned between opposing aft caissons, said horizontal braces resisting spreading and torque-inducing forces acting on said caissons due to lateral bending of said pontoons; and a station keeping means comprising a plurality of independently operating thruster assemblies mounted on each of said pontoons, on a port and a starboard side thereof, said thruster assemblies being accessible through a passageway formed in each of said pontoons, said passageway communicating with said platform from a level above an operational draft of said vessel.

8. The vessel of claim 7, wherein said thruster assemblies are mounted in opposing pairs along the starboard and port side of each of said pontoons.

9. The vessel of claim 7, wherein each of said braces is divided into a pair of watertight compartments divided by a longitudinal centerline bulkhead so as to retain operational stability of the vessel when structural integrity of a compartment wall is compromised.

10. The vessel of claim 7, wherein each of said braces has a generally oblong cross-section so as to minimize hydrodynamic drag forces.

11. The vessel of claim 7, wherein each of said pontoons has a generally rectangular cross section with outwardly convex corners to decrease drag forces acting on said vessel at an offshore location.

12. The vessel of claim 11, wherein a radius of said convex corner is at least one-fourth the depth of each of said pontoon for minimizing lateral or horizontal drag forces from current velocities.

13. A semi-submersible vessel, comprising:

a pair of buoyant pontoons;

a plurality of vertically extending buoyant caissons supported by said pontoons and arranged in pairs on each of said pontoons, upper portions of said caissons supporting a platform for conducting offshore operations, each of said caissons has an integral exterior vertical wall and a generally square cross-section, said wall being provided with outwardly convex corners to decrease drag forces acting on said vessel at an offshore location;

a plurality of parallel horizontal braces extending between each pair of opposing caissons in a transverse relationship to longitudinal axes of said pontoons, one of said pair of said horizontal braces being positioned between opposing forward caissons and another of pair of said horizontal braces being positioned between opposing aft caissons, said horizontal braces resisting spreading and torque-inducing forces acting on said caissons due to lateral bending of said pontoons;

a station keeping means comprising a plurality of independently operating thruster assemblies mounted on each of said pontoons, on a port and a starboard side thereof, said thruster assemblies being accessible through a passageway formed in each of said pontoons, said passageway communicating with said platform from a level above an operational draft of said vessel.

14. The vessel of claim 13, wherein a radius of said convex corner is at least one-fourth the width of the caisson.

* * * * *